US005295817A

United States Patent [19]

Young

[11] Patent Number: 5,295,817

[45] Date of Patent: Mar. 22, 1994

[54] APPARATUS AND METHOD FOR COMBUSTING CRUDE OIL

[75] Inventor: Timothy M. Young, Coppell, Tex.

[73] Assignee: Halliburton Company, Houston, Tex.

[21] Appl. No.: 932,438

[22] Filed: Aug. 19, 1992

[51] Int. Cl.[5] ..... F23D 11/44

[52] U.S. Cl. ..... 431/11; 431/202; 431/207; 431/247

[58] Field of Search ..... 431/11, 207, 12, 243, 431/247, 202, 89, 90, 208, 209

[56] References Cited

U.S. PATENT DOCUMENTS

| | | | |
|---|---|---|---|
| 2,955,420 | 10/1960 | Schirmer | 431/11 |
| 4,008,041 | 2/1977 | Roffe et al. | 431/11 |
| 4,065,247 | 12/1977 | Okigami et al. | 431/202 |
| 4,089,638 | 5/1978 | Trucco et al. | 431/243 |

*Primary Examiner*—James C. Yeung

*Attorney, Agent, or Firm*—Tracy W. Druce; Larry R. Watson

[57] ABSTRACT

Apparatus and method of combusting crude oil produced during testing of a subterranean well includes a primary nozzle for atomizing and spraying the primary feed of crude oil into a combustion chamber; a combustion chamber for receiving and combusting the atomized primary feed and confining the combustion so that the primary feed is completely combusted in the combustion chamber; and an ignitor for igniting the combustion. A secondary nozzle may be located in the combustion chamber for atomizing and spraying a secondary feed of crude oil into the combustion chamber so that the heat of combustion of the primary feed will vaporize the secondary feed and heat the secondary feed above its ignition temperature so that it will completely combust on contact with air. A heat exchanger may be provided which uses the heat from the combustion chamber for preheating the crude oil before the crude oil is supplied to the primary or secondary nozzle.

11 Claims, 3 Drawing Sheets 66
68
90
86
84
96
92
70
22,88
54
22,94
30
24
22,82
20
78
52
50
26
28
78
80
74
64
76
32
72

APPARATUS AND METHOD FOR COMBUSTING CRUDE OIL

BACKGROUND OF THE INVENTION

This invention relates to apparatus and method for combusting crude oil and, more particularly, relates to apparatus and method for combusting crude oil during oil well production tests.

The development and improvement of apparatus and methods for abating any pollution created during oil and gas exploration and production are a high priority for the industry. One source of such pollution is the hydrocarbon fluids produced during the well production tests which are conducted to provide an estimate of the maximum flow and composition of the fluids to be produced from a well. There are a number of uncertainties which create pollution-related problems during production tests. For example, some of the production tests are conducted after the well is drilled and before facilities are built to handle the produced fluids, since one purpose of the tests is to determine the type and capacity of equipment needed to process the produced fluids so that the fluids may be transported or stored. Once a production test is started, it must be allowed to continue for a known period of time to accurately predict the production capacity of a well; and, therefore, the disposal system must be able to accommodate the unknown, widely-fluctuating flow rates and unknown composition of the produced fluids. The oil produced during a well test often contains gas, contaminants, and particulate matter and is therefore difficult to store, transport, or burn, particularly on offshore platforms and in remote locations.

Because of these uncertainties, the current practice of the industry is to burn the produced fluids (hereinafter referred to as "crude oil"). To the best of applicant's knowledge, the crude oil produced during well tests has always been burned using open-air burners, i.e., flares in which the burner and flame are exposed to the open air. For examples see U.S. Pat. Nos. 3,565,562; 3,632,287; 3,797,992; 3,807,932; 3,914,094; 3,948,196; 3,980,416; 4,348,171; 4,412,811; and 4,452,583. These open-air burners are difficult to control and often produce large volumes of black smoke, volatile organic compounds, unburned hydrocarbons, carbon monoxide, nitrogen oxides, and unburned oil which is deposited on the land or water around the burner. This is attested to by some of the prior patents which disclose apparatus for reducing the smoke created during open-air burning.

Despite prior attempts to provide an environmentally acceptable open-air burner, none have proven entirely satisfactory. The present invention provides method and apparatus for burning the crude oil, as well as other hydrocarbon products, produced during a well test in a pollution abating, environmentally acceptable manner by enclosing a burner or nozzle and controlling the combustion of the crude oil so that a virtually pollution-free combustion is achieved. Although burners for commercial quality oil which enclose the flame are known, such as those disclosed in U.S. Pat. No. 2,701,608 and U.S. Pat. No. 3,603,711; as are burners for contaminated oil which partially enclose the flame to reduce noise levels during burning, as disclosed in U.S. Pat. No. 4,155,702; in the applicant's knowledge no attempt has been made to totally enclose the combustion of crude oil produced during well testing. Further, no attempt has been made to use the heat of combustion of the crude oil to enhance the combustion and produce a pollution abating combustion. It is contemplated that the wide range of flow rates and the unpredictable qualities of the crude oil encountered during well testing, as well as the extreme temperatures and the concern with keeping the size and cost of the disposal facilities at a minimum, have taught away from enclosing the combustion of crude oil produced during well tests.

SUMMARY OF THE INVENTION

The present invention is contemplated to overcome the foregoing deficiencies and meet the above-described needs. In accomplishing this, the present invention provides novel and improved method and apparatus for combusting crude oil. The invention includes a primary nozzle, connected to the source of crude oil, for atomizing and spraying a primary feed of the crude oil; a combustion chamber for receiving and combusting the atomized primary feed and confining the combustion so that the primary feed is completely combusted in the combustion chamber. A secondary nozzle may be provided for atomizing and spraying a secondary feed of crude oil into the combustion chamber. The secondary nozzle sprays the secondary feed into the combustion of the primary feed so that the heat of combustion of the primary feed will vaporize the secondary feed and will heat the secondary feed above its ignition temperature so that the vaporized secondary feed will completely combust on contact with air. The combustion chamber includes a heat exchanger which is used to heat the crude oil before the crude oil is supplied to the primary or secondary nozzle in order to reduce the viscosity and the droplet size of the crude oil atomized by the nozzles.

It is an advantage of the present invention to provide a relatively inexpensive, space efficient, enclosed crude oil burner.

It is an advantage of the present invention to provide a portable apparatus for combusting crude oil.

It is an advantage of the present invention to provide an enclosed incinerator for highly unstable combustible liquid wastes while accommodating widely fluctuating fuel flow rates.

BRIEF DESCRIPTION OF THE DRAWINGS

The present invention will be better understood by reference to the example of the following drawings.

DETAILED DESCRIPTION OF THE PREFERRED EMBODIMENTS

Figure 1:
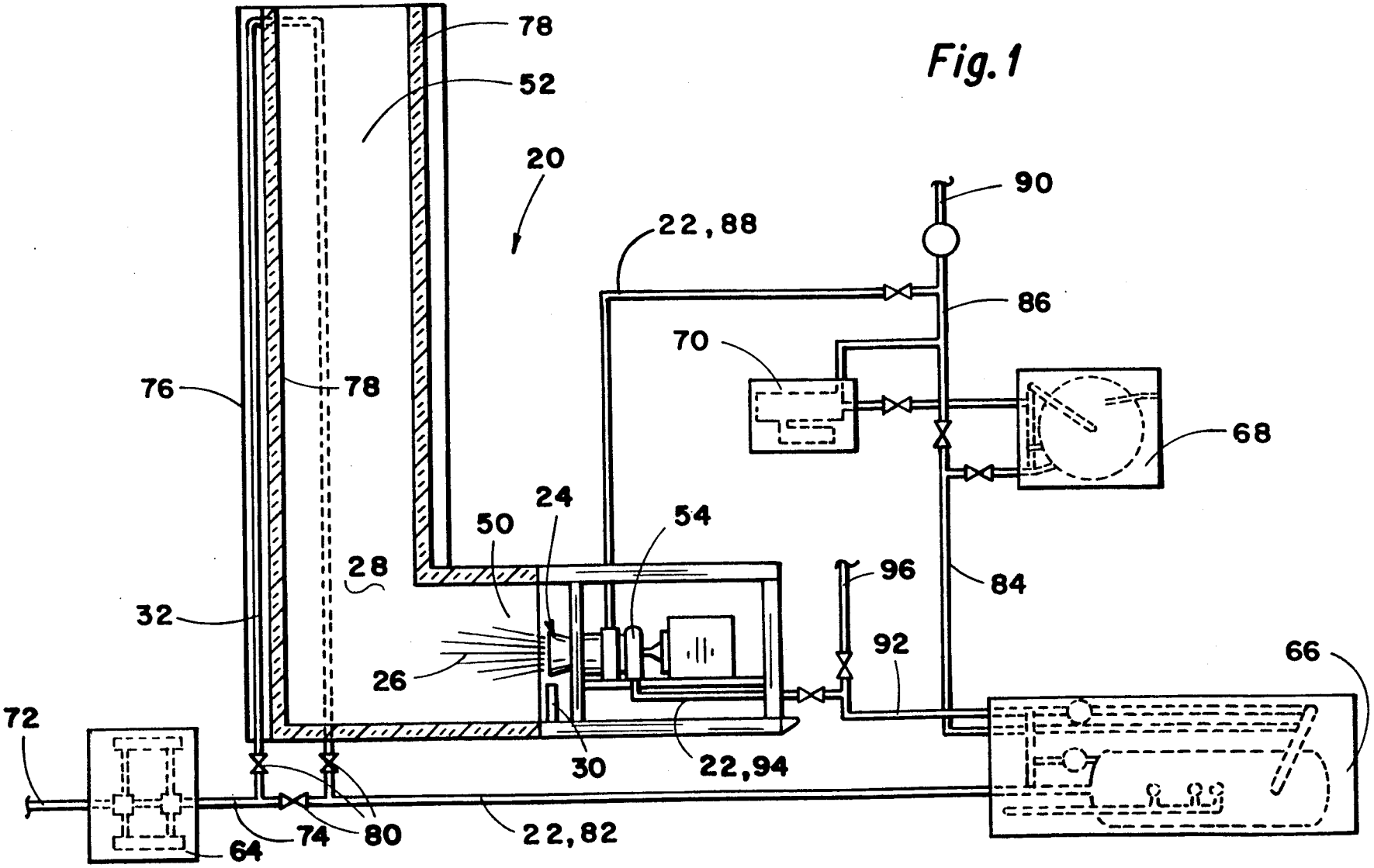
FIG. 1 is a schematic side view of an embodiment of the present invention.

Preferred embodiments of the invention will now be described with reference to the drawings, wherein like reference characters refer to like or corresponding parts throughout the drawings and description.

Figure 2:
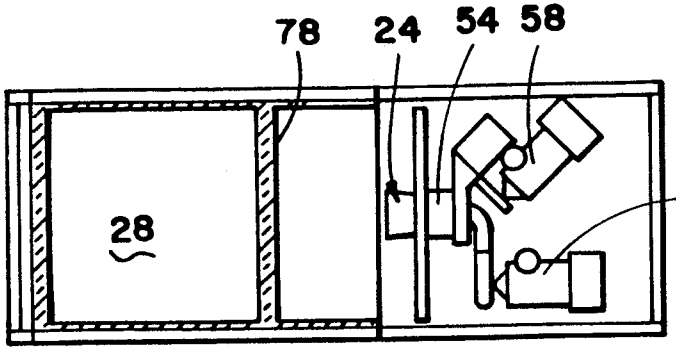
FIG. 2 is a schematic top view of the combustion chamber of FIG. 1.
Figure 3:
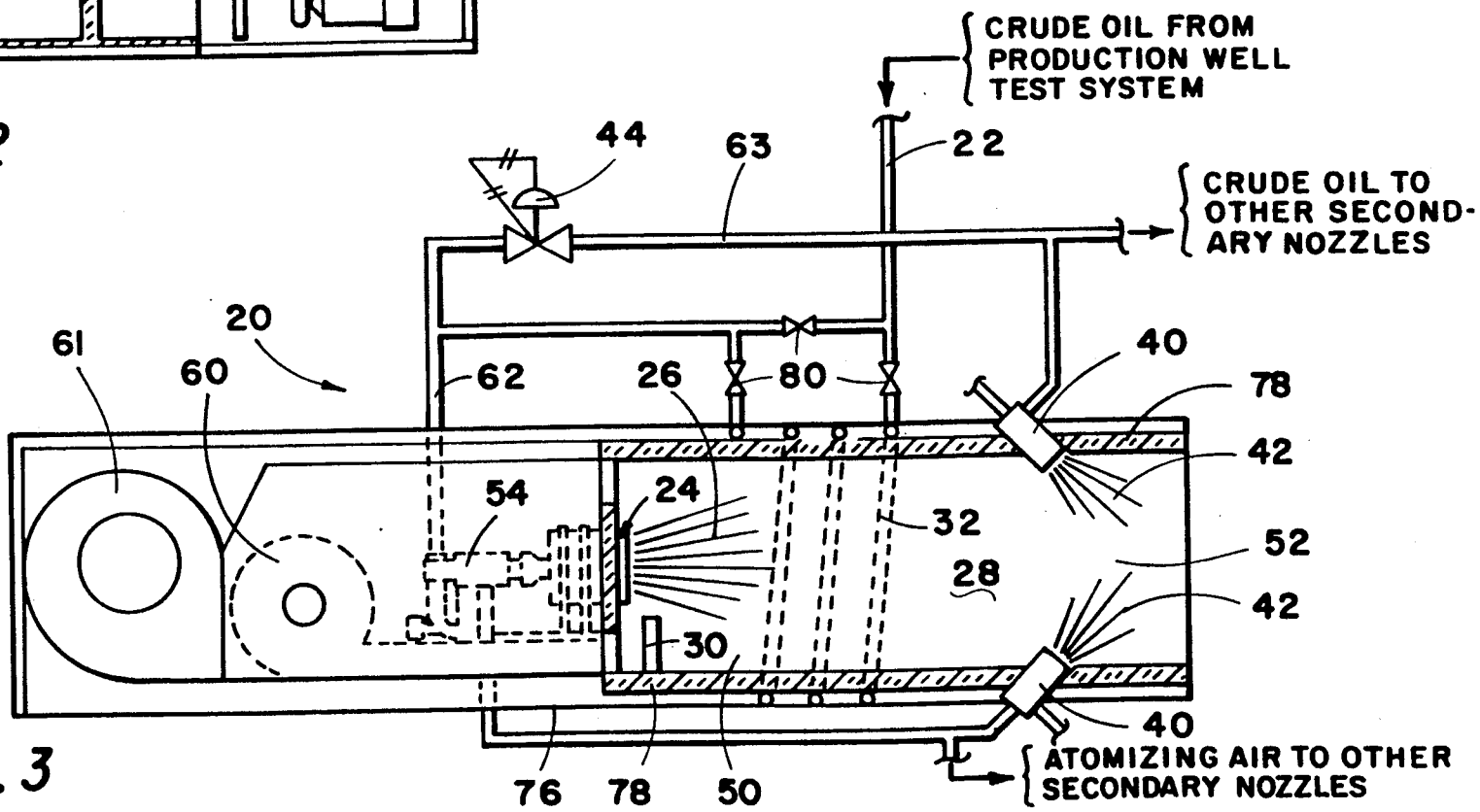
FIG. 3 is a schematic side view of a second embodiment of the present invention.

FIGS. 1–3 present embodiments of the apparatus and method of the present invention, generally designated 20, for combusting crude oil produced during testing of a subterranean well in a pollution-abating, environmentally acceptable manner. Although the apparatus and method 20 are described herein as used with crude oil produced during production well testing, it is intended to be understood that the invention may be used to combust virtually any combustible fluid provided from virtually any source. The invention is particularly suitable for combusting liquids at widely ranging, unpredictable flow rates which contain unpredictable types and quantities of contaminants and particulate matter.

Referring to the example of FIG. 1, the apparatus 20 may be generally described as including supply means 22 for fluid communicatingly connecting the apparatus 20 to the source of combustible fluid, such as the crude oil produced during testing; a primary nozzle 24, connected to the supply means 22, for atomizing and spraying a primary feed 26 of the crude oil; a combustion chamber 28 for receiving and combusting the atomized primary feed 26 and confining the combustion so that the primary feed 26 is completely combusted in the combustion chamber 28; and ignition means 30 for igniting the combustion. The primary nozzle 24 is located inside the combustion chamber 28.

The preferred combustion chamber 28 includes a heat exchanger 32 connected to the combustion chamber 28 in thermal communication with the combustion chamber 28. The supply means 22 is connected to the heat exchanger 32 for heating the crude oil before the crude oil is supplied to the primary nozzle 24 for combustion. Preheating the crude oil reduces the viscosity of the crude oil which in turn decreases the droplet size of the crude oil atomized by the primary nozzle 24 and sprayed in the primary feed 26.

FIGS. 1 and 2 exemplify a first embodiment of the invention in which the secondary nozzles 40, discussed below, will not normally be used. Referring to the example of FIG. 3, in a second embodiment, the apparatus 20 includes a secondary nozzle 40, connected to the supply means 22 and located in the combustion chamber 28, for atomizing and spraying a secondary feed 42 of crude oil into the combustion chamber 28. Preferably, the secondary nozzle 40 sprays the secondary feed 42 into the combustion of the primary feed so that the heat of combustion of the primary feed 26 will vaporize the secondary feed 42. More preferably, the secondary feed 42 is heated above the ignition temperature of the vaporized secondary feed by exposure to (i.e., heat exchange with) the combustion of the primary feed so that the vaporized secondary feed will completely combust on contact with air. Preferably, the supply means 22 is connected to the heat exchanger 32 for heating the crude oil before the crude oil is supplied to the secondary nozzle 40 in order to reduce the viscosity of the crude oil and decrease the droplet size of the crude oil atomized by the secondary nozzle 40.

In the second embodiment, control means 44 is providing for controlling the flow of crude oil to the primary nozzle 24 and to the secondary nozzle 40. The control means 44 is used to divert the flow of crude oil in excess of the flow capacity of the primary nozzle 26 to the secondary nozzle 40.

The method of the present invention includes atomizing and spraying a primary feed 26 of the crude oil into a combustion chamber 28; igniting the primary feed 26 in the combustion chamber 28; and completely vaporizing and combusting the primary feed 26 in the combustion chamber 28. The method provides for heating the primary feed 26 by heat exchange with the combustion chamber 28 before the primary feed 26 is sprayed into the combustion chamber 28 in order to reduce the viscosity and decrease the droplet size of the crude oil in the primary feed 26.

In a preferred embodiment, the method includes atomizing and spraying a secondary feed 42 of crude oil into the combustion chamber 28. The method further provides for vaporizing the secondary feed 42 in the combustion chamber 28 with the heat of combustion of the primary feed 26. The method still further provides for heating the vaporized secondary feed 42 in the combustion chamber 28 to a temperature above the ignition temperature of the vaporized secondary feed 42 so that the vaporized secondary feed will completely combust on contact with air.

The preferred method also provides for limiting the flow capacity of the primary feed 26 into the combustion chamber 28 and diverting to the secondary nozzle the flow of crude oil in excess of the flow capacity of the primary feed 26. The method provides for heating the secondary feed 42 by heat exchange with the combustion chamber 28 before the secondary feed 42 is sprayed into the combustion chamber 28 in order to reduce the viscosity and decrease the droplet size of the crude oil in the secondary feed 42.

A more detailed description of the invention, its operation, and the components used with the invention will now be provided. Referring to the example of FIG. 1, in the first embodiment of the invention, the combustion chamber 28 includes an inlet end 50 and an outlet end 52. Although the design of the first embodiment may be adapted to virtually any flow rate, in the preliminary design of the first embodiment a primary nozzle 24 having a large capacity, such as 2,000 barrels of oil per day ("BOPD") is provided and secondary nozzle(s) 40 is not used (although secondary nozzle(s) may be added to increase the capacity of the first embodiment). The preliminary design of the first embodiment will typically be used at locations in which space is not a critical factor, as the combustion chamber 28 must be large (relative to the second embodiment discussed below) to accommodate the large capacity primary nozzle 24.

Preferably, the inlet end 50 is a horizontal section and the outlet end 52 is a vertical section of suitable conduit. In the preliminary design the inlet end 50 comprises two 20-foot ISO (International Standards Organization) containers placed side by side and the outlet end 52 comprises two vertically oriented 40-foot ISO containers. The containers are insulated, preferably with ceramic fiber insulation 78, to reduce the heat radiated by the container and to increase the heat inside the combustion chamber 28.

The primary nozzle 24 is located in the inlet end 50 of the chamber 28. The primary nozzle 24 is supported by a primary burner structure 54 which conducts the crude oil to the primary nozzle 24 for atomization. The primary nozzle 24 may use the fluid pressure of the crude oil or may use pressurized atomizing air to atomize the crude oil. It is contemplated that the preferred primary nozzle 24 will use compressed air to atomize the crude oil and may also use gas if gas is contained in and separated from the crude oil, as will be further discussed below. Such primary nozzles 24 and burner structures are well known and commercially available, such as the Star Jet Burners currently manufactured by Hauck Manufacturing Co. This burner structure includes multiple primary nozzles having a combined burning capacity of more than 1,000,000 BTU per hour. The multiple nozzles may be selected and arranged to inject the crude oil and atomizing air in such a manner that the velocity of the combustion flow through the chamber 28 does not damage the insulation 78, as would be known to one skilled in the art in view of the disclosure contained herein. According to preliminary calculations, the combustion should be complete approximately three feet before the discharge of the outlet end 52. According to preliminary calculations, the combustion temperature will be between 2,650° Fahrenheit and 2,550° Fahrenheit and the chamber temperature will be approximately 2,250° Fahrenheit.

According to preliminary calculations, the combustion will be smoke-free and relatively low levels of unburned volatile organic compounds ("VOCs") and carbon monoxide ("CO") will escape the outlet end 52. These combustibles will burn when they contact the air.

The temperature required to achieve the desired combustion intensities dictates that the combustion chamber 28 be adequately insulated along its entire length and that a radiation shield be installed to protect the burner. As previously mentioned, the preferred insulation 78 is ceramic fiber and it is contemplated that approximately 8 inches of ceramic fiber insulation will be required.

In the preliminary design, two engine-driven air blowers 56, 58, best seen in FIG. 2, will be supplied. The apparatus 20 will operate with only one blower 56, 58 and the second will be provided as a backup. The combustion air blower horsepower requirement for the preliminary design is 100 brake-horsepower ("BHP"). The total air provided by the air blower will only supply approximately 9% of the air required for combustion. The vertical height of the outlet end 52 and discharge temperature will provide approximately 0.488 inch water column draft which should be sufficient to induce the 92,166 standard cubic feet per minute of air needed for combustion with an additional 10% of excess air, according to preliminary calculations. The size of the combustion chamber 28 may be reduced by using forced draft, i.e., by using engine-driven air blowers dedicated to providing combustion air rather than utilizing induced draft to provide the combustion air requirements.

In order to achieve an efficient, pollution-free combustion, it is important that the primary nozzle 24 atomize the crude oil to a droplet size which will vaporize and burn at the combustion temperature in the combustion chamber 28. According to preliminary calculations, based on a specific 24° API crude oil, in order to achieve such a degree of atomization the crude oil must be supplied to the primary nozzle 24 at a maximum viscosity of 18 centipoise and at approximately 45 pounds per square inch. In order to reduce the viscosity to this level, the crude oil is preheated in the heat exchanger 32 before it is supplied to the primary nozzle 24, as will be further discussed below.

FIG. 3 exemplifies a preliminary design of the second preferred embodiment of the present invention. In the second embodiment of the of the invention, the combustion chamber 28 includes an inlet end 50 and an outlet end 52. Although the design of the second embodiment may be adapted to any flow rate, in the preliminary design, the primary nozzle 24 has a capacity of 142 million BTU per hour, or approximately 500 BOPD. The combustion chamber 28 is sized to completely contain the combustion produced by the primary nozzle 24. The preliminary design of the second embodiment is intended for use in locations in which space is a critical factor, such as on offshore platforms. It is also intended for locations to which it is difficult to transport large equipment.

Preferably, the combustion chamber of the second embodiment has an inlet end 50 and an outlet end 52 at opposite ends of a generally linear longitudinal chamber axis. In the preliminary design, the second embodiment is self-contained in a single 40 foot ISO container. The container 28 is insulated, preferably with ceramic fiber insulation 78, to reduce the heat radiated by the chamber 28 and to increase the heat inside the combustion chamber. It is contemplated that the chamber 28 will normally be operated with the chamber axis in a generally horizontal orientation. It is desirable, in all embodiments of the invention, to place the primary nozzle 24 in a horizontal section of the combustion chamber 28 so that falling liquid, or other materials, are not deposited on the primary nozzle 24.

The primary nozzle 24 is located in the inlet end 50 of the chamber 28. The primary nozzle 24 is supported by a primary burner structure 54 which conducts the crude oil to the nozzle 24 for atomization. The primary nozzle 24 may use the fluid pressure of the crude oil or may use pressurized atomizing air to atomize the crude oil. It is contemplated that the preferred primary nozzle 24 will use compressed air to atomize the crude oil and may also use gas if gas is contained in and separated from the crude oil. Such primary nozzles 24 are well known and commercially available, such as the Star Jet Burners currently manufactured by Hauck Manufacturing Co. The preferred nozzle 24 will have air spin vanes near the nozzle to create turbulence and a refractory tile around the nozzle which will enable a very stable, short, bushy flame which does not contact the insulation 78. The preferred burner 24 is sealed to prevent backfire and so that the combustion products must exit the outlet end 52 of the combustion chamber 28. According to preliminary calculations, the combustion temperature will be approximately 2,400° Fahrenheit in the chamber 28 and the combustion will be smoke free with relatively low levels of unburned VOCs and carbon monoxide escaping the outlet end 52. Any combustibles which may escape will burn when they contact the air outside the combustion chamber 28.

In the preliminary design, two engine-driven air blowers, best seen in FIG. 3, will be supplied, one being an atomizing air blower 60 and the other being a combustion air blower 61. The atomizing air blower 60 will require approximately 100 brake-horsepower ("BHP"). The combustion air blower 61 will require approximately 100 BHP and will supply all of the air for combustion. The combustion intensity in the chamber 28 will be 250,000 to 275,000 BTU per cubic foot per hour.

In order to accommodate the wide-ranging flow rates which may be encountered in production well testing service, while keeping the size of the second embodiment to a minimum, at least one secondary nozzle 40 will be provided. In the preliminary design of the second embodiment, four secondary nozzles 40 are provided near the outlet end 52 of the chamber 28. The secondary nozzles 40 will inject the secondary feed 42 (which will normally be oil in excess of the 500 BOPD capacity of the primary nozzle 24) into the heat of combustion of the primary feed 26. Therefore, as previously discussed, the secondary feed will be vaporized and heated to a temperature above its ignition temperature so that it will burn when it comes into contact with air. Normally, the combustion of the secondary feed 42 will take place outside of the combustion chamber 28. Because of the vaporization and heating of the secondary feed 42 in the combustion chamber 28, the combustion of the secondary feed outside the combustion chamber is expected to be much more efficient and produce much less pollution than the known open air burners.

The preferred secondary nozzles 40 each have a capacity of 568 million BTU per hour and use compressed air and/or gas to atomize the crude oil. The preferred secondary nozzles 40 use the atomizing air/gas to generate turbulence and use the flame of the primary nozzle 24 to create stability in their own flames. The secondary nozzles 40 may also be used as backup nozzles, i.e., the primary nozzle 24 can be shut down for maintenance or replacement once the secondary nozzles 40 have been ignited and the secondary nozzles 40 may then be used to combust the full flow of crude oil to the apparatus 20.

In order to achieve an efficient, pollution-free combustion, it is important that the primary nozzle 24 and secondary nozzles 40 atomize the crude oil to a droplet size which will vaporize and burn at the temperature in the combustion chamber 28. In order to reduce the viscosity to this level, the crude oil is preheated in the heat exchanger 32 before it is supplied to the primary nozzle 24 and secondary nozzle 40, as has been previously discussed.

The preferred second embodiment includes control means 44 for controlling the flow of crude oil to the primary nozzle 24 and the secondary nozzle 40. The control means 44 may be a pressure regulator which senses the pressure of the crude oil supplied to the primary nozzle 24 and supplies the excess crude oil to the secondary nozzles 40 when the pressure of the crude oil supplied to the primary nozzle 24 exceeds a preselected pressure. Alternatively, a flow meter (not illustrated) may be provided in the primary oil line 62 and used to generate a signal which will be used to open the secondary oil line 63 to the secondary nozzles 40 when the flow to the primary nozzle 24 exceeds a preselected flow. The flow meter may also be visually monitored by operating personnel and the secondary oil line 63 opened manually when the flow to the primary nozzle 24 exceeds a preselected amount.

Having previously discussed two preferred embodiments of the present invention, the following discussion is generally applicable to all embodiments of the present invention. FIG. 1 illustrates a representative supply means 22 for supplying the crude oil to the apparatus 20 for combustion. In the example of FIG. 1, the supply means 22 is connected to a production well test system which includes choke manifold 64, horizontal separator and metering skid 66, vertical test tank 68, and pump 70. This is one of many possible arrangements and equipment configurations for a production well test system and is not intended to be limiting, but is provided to facilitate an understanding of the operation of the invention. Produced fluids flow from the subterranean well to the choke manifold 64 through production line 72. The choke manifold 64 controls the pressure of the fluid downstream of the choke manifold. From the choke manifold 64 the produced fluid flows through line 74 to heat exchanger 32. The preferred heat exchanger 32 comprises a pipe or conduit which is placed in a cavity between the outside wall 76 of the combustion chamber and the insulation 78 in the combustion chamber. The heat exchanger piping 32 may be arranged in any suitable manner in the cavity to achieve the desired heat exchange, as would be known to one skilled in the art in view of the disclosure contained herein. The thickness of the insulation 78 between the heat exchanger piping 32 and the interior of the combustion chamber 28 may be selected to achieve a desired heat exchange. It is contemplated that the heat exchanger 32 and insulation 78 should be selected such that the skin temperature of the heat exchanger piping 32 be kept at a skin temperature of below 800° Fahrenheit in order to prevent coking of the oil in the heat exchanger piping 32. Bypass valves 80 are provided to control the flow of crude oil through the heat exchanger piping 32. The bypass valves may be automated and a temperature control system (not illustrated) may be provided to control the temperature of the crude oil in the heat exchanger piping 32 and in the supply means 22 and line 82 downstream of the heat exchanger 32.

From the heat exchanger 32 the crude oil flows through line 82 to the horizontal separator and metering skid 66. In the horizontal separator and metering skid, gas is separated from the crude oil and the flow of fluids from the subterranean well is metered. From the horizontal separator and metering skid 66, crude oil flows through line 84 to the vertical test tank 68. From the vertical test tank 68, crude oil flows to pump 70 which injects the crude oil into line 86. From line 86 the crude oil flows into oil supply line 88 of the supply means 22 from which it is supplied to the primary nozzle 24 (and to the secondary nozzle 40 in the second embodiment). A bypass line 90 may also be provided to dispose of crude oil from line 86 which is not burned in apparatus 20.

Gas from the horizontal separator and metering skid 66 is conducted through line 92 to gas supply line 94 of the supply means 22. Line 94 connects the gas to the primary nozzle 24. As has been previously discussed, the gas may also be connected to the secondary nozzles 40 (not illustrated). Line 96 is provided to conduct gas to other gas users and gas disposal systems.

In the preliminary designs, which use atomizing air to atomize the crude oil, the pressure at the primary and secondary nozzles 24, 40 will be determined by the flow rate, e.g., a level control valve in the production well test system (such as on the horizontal test separator) will control flow which will in turn determine the pressure at the nozzles 24, 40. The pressure at the nozzles 24, 40 should be no lower than 45 PSI. If the nozzles 24, 40 use liquid pressure to produce the desired atomization, they will typically need to be operated at approximately 350 PSI.

In order to accommodate low gravity crude oils which are difficult to burn, the preferred embodiments will be designed to fire with diesel fuel until operating temperatures are reached in the combustion chamber 28 and the crude oil and heat exchanger 32 is heated to the desired temperature, at which time the primary nozzle 24 will be switched to crude oil. After the primary nozzle 24 is operating on crude oil and the desired temperature is reached in the combustion chamber 28, the additional nozzles on the primary nozzle 24 of the first embodiment or the secondary nozzles 40 on the second embodiment may be started and will be ignited by the combustion produced by the primary nozzle 24. The preferred ignition means 30 is a liquified petroleum gas ("LPG") fueled flame or pilot. Preferably, the ignition means 30 will be located in the combustion chamber 28 just below the primary feed 26.

Figure 4:
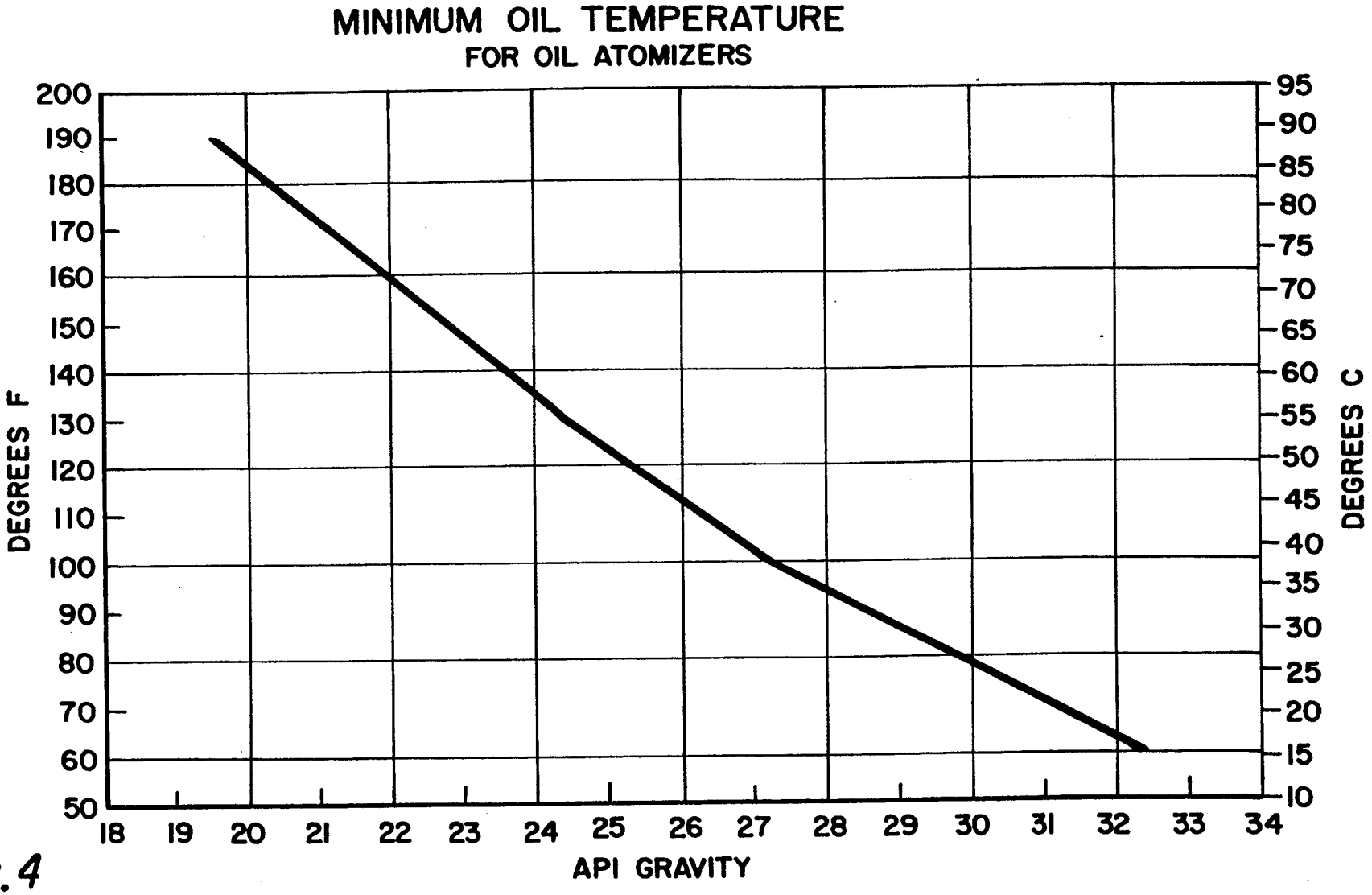
FIG. 4 is a chart plotting the recommended minimum oil temperature against API specific gravity for the oil to be atomized and burned in accordance with the present invention.

Burning the crude oil inside the combustion chamber 28 allows control of the temperature, fuel residence time, and turbulence in the combustion chamber 28, which are all significant factors for efficient combustion. The combustion of the primary feed 26 provides a source of heat, the combustion chamber 28 provides the containment and fuel residence time necessary to create a very high temperature, and the atomizing nozzles 24, 40 create the turbulence and droplets needed to create an efficient combustion. Reducing the droplet size accelerates the vaporization process and improves combustion, i.e., reduced droplet size produces less black smoke, less unburned combustibles, and less hydrocarbon fallout. An advantage of the present invention is to reduce the droplet size sufficiently that the droplets will vaporize and burn completely. FIG. 4 presents a chart of the minimum oil temperature versus specific gravity ("API gravity") determined by the inventor to produce the desired droplet size. The heat exchanger 32 should be designed to preheat the crude oil to the minimum temperatures identified in FIG. 4. The crude oil should not be heated to a temperature above 800° F. to avoid coking of the crude oil in the piping.

Although representative sizings and capacities of the apparatus 20 have been discussed above, the actual capacity is defined by the heating value of the fluid to be combusted, as would be known to one skilled in the art in view of the disclosure contained herein. The physical size of the combustion chamber 28 is dictated by the desired burning capacity. As a rule of thumb, the burning capacity of the combustion chamber 28 is approximately 150,000 BTU per cubic foot of volume. This formula is dependent upon the nozzles 24, 40 and the nozzles' and combustion chamber's abilities to mix air with fuel. The preferred nozzles 24, 40 and blowers 56, 58, 60, 61 allow the fuel air mixture to be adjusted to assist in controlling emissions from the combustion chamber 28.

Other controls and flame safety equipment used with the apparatus will include: a microprocessor temperature controller, high temperature limit protection, flame supervision and metering, panel status indicating lights, self-checking limits circuitry, a time-adjustable purge cycle, relay logic reliability, and operator programmable features. A safety system will be provided which will include a start-up sequence, engine shutdown, and oil bypass circuit.

While presently preferred embodiments of the invention have been described herein for the purpose of disclosure, numerous changes in the construction and arrangement of parts and the performance of steps will suggest themselves to those skilled in the art in view of the disclosure contained herein, which changes are encompassed within the spirit of this invention, as defined by the following claims.

What is claimed is:

1. Apparatus for continuously combusting crude oil liquids produced during testing of a subterranean well in a pollution-abating manner, comprising:

supplying means for fluid communicatingly connecting the apparatus to the crude oil during testing;

a primary liquid nozzle, connected to the supply means, for atomizing and spraying a primary feed of the crude oil;

a combustion chamber for receiving and combusting the atomized primary feed and confining the combustion so that the primary feed is completely combusted in the combustion chamber, the primary nozzle being located inside the chamber;

a secondary liquid nozzle, connected to the supply means and located in the combustion chamber, for atomizing and spraying a secondary feed of crude oil into the combustion chamber for combustion; and wherein the spray of the secondary feed is further defined as being heated above the ignition temperature of the secondary feed by the combustion of the primary feed so that the heated secondary feed will completely combust on contact with air outside the combustion chamber; and ignition means for igniting the combustion.

2. Apparatus of claim 1 in which the combustion chamber comprises:

a heat exchanger connected to the combustion chamber in thermal communication with the combustion chamber; and wherein the supply means is connected to the heat exchanger for heating the crude oil before the crude oil is supplied to the primary nozzle for combustion in order to reduce the viscosity of the crude oil and decrease the droplet size of the crude oil atomized by the primary nozzle.

3. Apparatus of claim 1 in which the combustion chamber comprises:

a heat exchanger; and wherein the supply means is connected to the heat exchanger for heating the crude oil before the crude oil is supplied to the secondary nozzle in order to reduce the viscosity of the crude oil and decrease the droplet size of the crude oil atomized by the secondary nozzle.

4. Apparatus of claim 2, comprising:

control means for controlling the flow of crude oil to the primary nozzle and to the secondary nozzle; and wherein the primary nozzle has a flow capacity; and wherein the control means is further defined as diverting to the secondary nozzle the entire flow of crude oil in excess of the flow capacity of the primary nozzle.

5. Apparatus for combusting crude oil, containing unpredictable types and quantities of contaminants and particulate matter, at a wide and unpredictable range of flow rates such as the crude oil produced during testing of a subterranean well, in a pollution-abating and environmentally acceptable manner, comprising:

supply means for fluid communicatingly connecting the apparatus to the crude oil;

a primary liquid nozzle, connected to the supply means, for atomizing and spraying a primary feed of the crude oil;

a combustion chamber for receiving and combusting the atomized primary feed and combining the combustion so that the primary feed is completely combusted in the combustion chamber, the combustion chamber having an inlet end and an outlet end with the primary nozzle being located inside the chamber near the inlet end;

a secondary liquid nozzle, connected to the supply means and located in the chamber, for atomizing and spraying a secondary feed of crude oil into the chamber between the primary nozzle and the outlet end of the chamber so that the combustion of the primary feed will heat and maintain the secondary feed above its ignition temperature in the combustion chamber and the secondary feed will combust upon discharge from the combustion chamber and contact with outside air; and combustion chamber and contact with outside air; and ignition means for igniting the combustion.

6. Apparatus of claim 5 in which the combustion chamber comprises:

a heat exchanger connected to the combustion chamber in thermal communication with the combustion chamber; and wherein the supply means is connected to the heat exchanger for heating the crude oil before the crude oil is supplied to the primary or secondary nozzle in order to reduce the viscosity of the crude oil and decrease the droplet size of the crude oil atomized by the primary or secondary nozzle.

7. Apparatus of claim 5, comprising:

control means for controlling the flow of crude oil to the primary nozzle and to the secondary nozzle; and wherein the primary nozzle has a flow capacity; and wherein the control means is further defined as diverting to the secondary nozzle the flow of crude oil in excess of the flow capacity of the primary nozzle.

8. Method of combusting crude oil produced during testing of a subterranean well in a pollution-abating, environmentally acceptable manner, comprising:

atomizing and spraying a primary feed of the crude oil into a combustion chamber;

igniting the primary feed in the combustion chamber;

completely vaporizing and combusting the primary feed in the combustion chamber;

atomizing and spraying a secondary feed of crude oil into the combustion chamber;

heating and maintaining the secondary feed at a temperature above the ignition temperature of the secondary feed in the combustion chamber so that the heated secondary feed will combust on contact with air; and discharging the heated secondary feed from the combustion chamber for combustion with air outside the combustion chamber.

9. Method of claim 8, comprising:

heating the primary feed by heat exchange with the combustion chamber before the primary feed is sprayed into the combustion chamber in order to reduce the viscosity and decrease the droplet size of the crude oil in the primary feed.

10. Method of claim 8, comprising:

heating the secondary feed by heat exchange with the combustion chamber before the secondary feed is sprayed into the combustion chamber in order to reduce the viscosity and decrease the droplet size of the crude oil in the secondary feed.

11. Method of claim 8, comprising:

limiting the flow capacity of the primary feed into the combustion chamber; and diverting to the secondary nozzle the entire flow of crude oil in excess of the flow capacity of the primary feed.

* * * * *